United States Patent [19]

Bastian

[11] Patent Number: 4,667,605

[45] Date of Patent: May 26, 1987

[54] ADJUSTABLE TABLE LEG ASSEMBLY

[75] Inventor: John M. Bastian, Two Rivers, Wis.

[73] Assignee: Hamilton Industries, Inc., Two Rivers, Wis.

[21] Appl. No.: 909,688

[22] Filed: Sep. 22, 1986

[51] Int. Cl.[4] ..... A47B 9/00

[52] U.S. Cl. ..... 108/144; 108/106; 248/188.5

[58] Field of Search ..... 108/144, 148, 146, 147, 108/10, 106, 151; 297/353; 248/413, 354.4; 403/331, 26; 248/188.5

[56] References Cited

U.S. PATENT DOCUMENTS

| | | | |
|---|---|---|---|
| 1,851,965 | 4/1932 | Bartholomae et al. | 108/144 X |
| 2,806,722 | 9/1957 | Atkins | 248/413 X |
| 2,983,474 | 5/1961 | Hanna | 248/161 |
| 3,314,384 | 4/1967 | Mann et al. | 108/144 X |
| 3,347,511 | 10/1967 | Myers | 108/147 X |
| 3,604,734 | 9/1971 | Friedman | 108/146 X |
| 3,896,744 | 7/1975 | Goebl | 108/146 |
| 3,920,209 | 11/1975 | Komura | 108/146 X |
| 4,080,080 | 3/1978 | Cisler | 248/188.5 X |
| 4,619,208 | 10/1986 | Kurrasch | 108/147 X |

FOREIGN PATENT DOCUMENTS

| | | | |
|---|---|---|---|
| 284813 | 9/1965 | Australia | 108/106 |
| 2051705 | 12/1971 | Fed. Rep. of Germany | 248/413 |
| 2095542 | 10/1982 | United Kingdom | 108/144 |

*Primary Examiner*—Kenneth J. Dorner
*Assistant Examiner*—José V. Chen
*Attorney, Agent, or Firm*—Tilton, Fallon, Lungmus

[57] ABSTRACT

A vertically-adjustable leg assembly particularly suitable for a pedestal table, the assembly having telescoping inner and outer tubes of generally rectangular cross section with the external dimensions of the inner tube being sufficiently smaller than the corresponding internal dimensions of the outer tube to define a perimetric space between them. A pair of vertically-elongated, channel-shaped bearing blocks formed of rigid polymeric material are located in the space between the two tubes and are supported by the outer tube adjacent the open end thereof. At least one of the bearing blocks is adjustably mounted and is constructed so that adjustment forces exerted at spaced points will be distributed along the length of the block. The end of the inner tube disposed within the outer tube has channel-shaped bearing shoes, also formed of rigid polymeric material, secured thereto and slidably engagable with the inner surfaces of the outer tube.

20 Claims, 5 Drawing Figures

17
44
55
43
46
40a
41
40
43
41
40a
40
33
32
30
34
45
31
32
20
35
20b
20a
35
52
53
56
54
57
57
56
51
52
20b
50

ADJUSTABLE TABLE LEG ASSEMBLY

BACKGROUND AND SUMMARY

While the prior art discloses a variety of extendable /retractable telescoping leg assemblies for tables, some of which include bearing means formed of polymeric material, the need has nevertheless remained for an assembly that is readily adjustable to provide minimal resistance to vertical sliding movement of the parts yet, at the same time, virtually eliminate play and wobble. The problem is particularly significant with large and relatively heavy tables used for drafting or reference purposes where the weight of the upper sections must be counterbalanced or where power assist is required for raising and lowering the upper sections. Under such circumstances, separation of the two sections for the purpose of adjusting the bearing elements carried by the inner telescoping members becomes a practical impossibility. If openings are provided in the outer telescoping members to permit access for adjustment purposes, such openings are not only unsightly but serve as entry points for dirt and foreign objects. The problems of achieving and maintaining smooth operation, and of adjusting the bearings to achieve such objectives, are magnified in table constructions having two (or more) telescoping pedestal legs connected to a cantilever top designed to support substantial loads, since power operation for expanding and retracting the two legs must be synchronized while at the same time both play and operating resistance must be equalized at minimum values.

U.S. Pat. Nos. 4,130,069, 3,888,444, 4,080,080, 3,004,743, 3,820,176, 2,983,474, 4,183,689, and 4,254,928 are illustrative of the known prior art.

Briefly, the adjustable leg or column assembly of this invention includes a vertical outer tube having inner surfaces defining a cavity or passage of generally rectangular cross section, a vertical inner tube telescopingly received in that cavity, the inner tube having outer surfaces of generally rectangular outline when viewed in cross section and being sufficiently smaller than the inside dimensions of the outer tube to define a perimetric space between them. A pair of vertically elongated bearing blocks of channel-shaped cross sectional configuration and of rigid polymeric material are connected to the inside of the outer tube adjacent its open end and are arranged so that the channels of the bearing blocks face each other and slidably receive opposite side portions of the rectangular inner tube. The length of the bearing blocks should be substantial (in the general range of 20 to 40% of the length of the outer telescoping tube) and at least one of the blocks should be mounted for adjustment so that its upper and lower end portions may be shifted towards and away from the contact surfaces of the inner telescoping tube. Adjustment forces, applied by adjustment screws threadedly carried by the outer telescoping tube, are distributed along the length of the adjustable block. Since the adjustment screws are readily accessible from the exterior of the outer tube, play or clearance may be easily adjusted not only at the time of manufacture or installation but also after an interval of use during which wear or loosening may have occurred. The end of the inner telescoping tube that is received in the outer tube also has bearing elements connected to it. Such bearing elements or shoes are relatively short and non-adjustable but have cross sectional configurations somewhat similar to those of the elongated bearing blocks. Also, like the bearing blocks, they are formed of rigid polymeric material.

Other features, advantages, and objects will become apparent from the specification and drawings.

DRAWINGS

DETAILED DESCRIPTION OF PREFERRED EMBODIMENT

Figure 1:
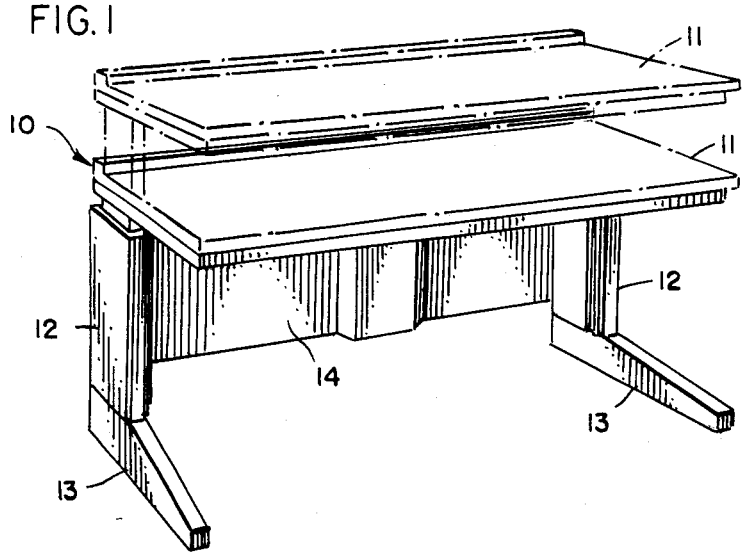
FIG. 1 is a perspective view of a vertically-adjustable twin-pedestal table equipped with a pair of telescoping support columns permitting vertical movement between the lowered (solid line) and raised (broken line) positions illustrated.

Referring to FIG. 1, the numeral 10 generally designates a pedestal table having a top 11 and a pair of extendable/retractable leg assemblies 12. The top is mounted in cantilever fashion and extends over base members 13 at the lower ends of the two leg assemblies. A housing 14 stretches between the leg assemblies and performs the multiple functions of rigidly connecting those assemblies, concealing the power unit for expanding and retracting the telescoping leg members, and serving as a modesty panel. Solid lines depict a table in its lowered position, whereas phantom lines show the table with the top in a raised position.

Figure 2:
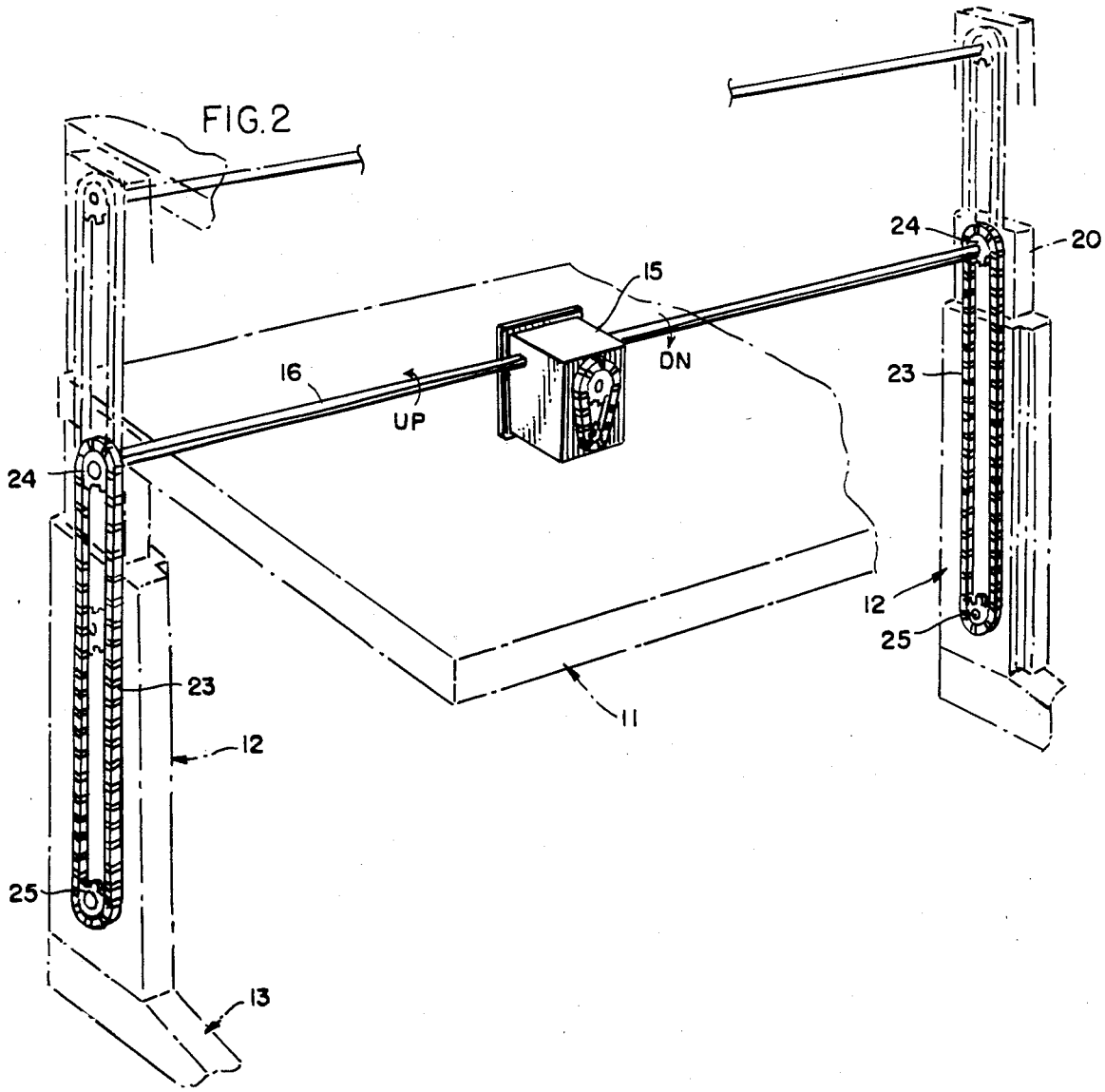
FIG. 2 is a fragmentary perspective view illustrating the relationship between the power mechanism for raising and lowering the tabletop and the telescoping columns or legs supporting that top.
Figure 3:
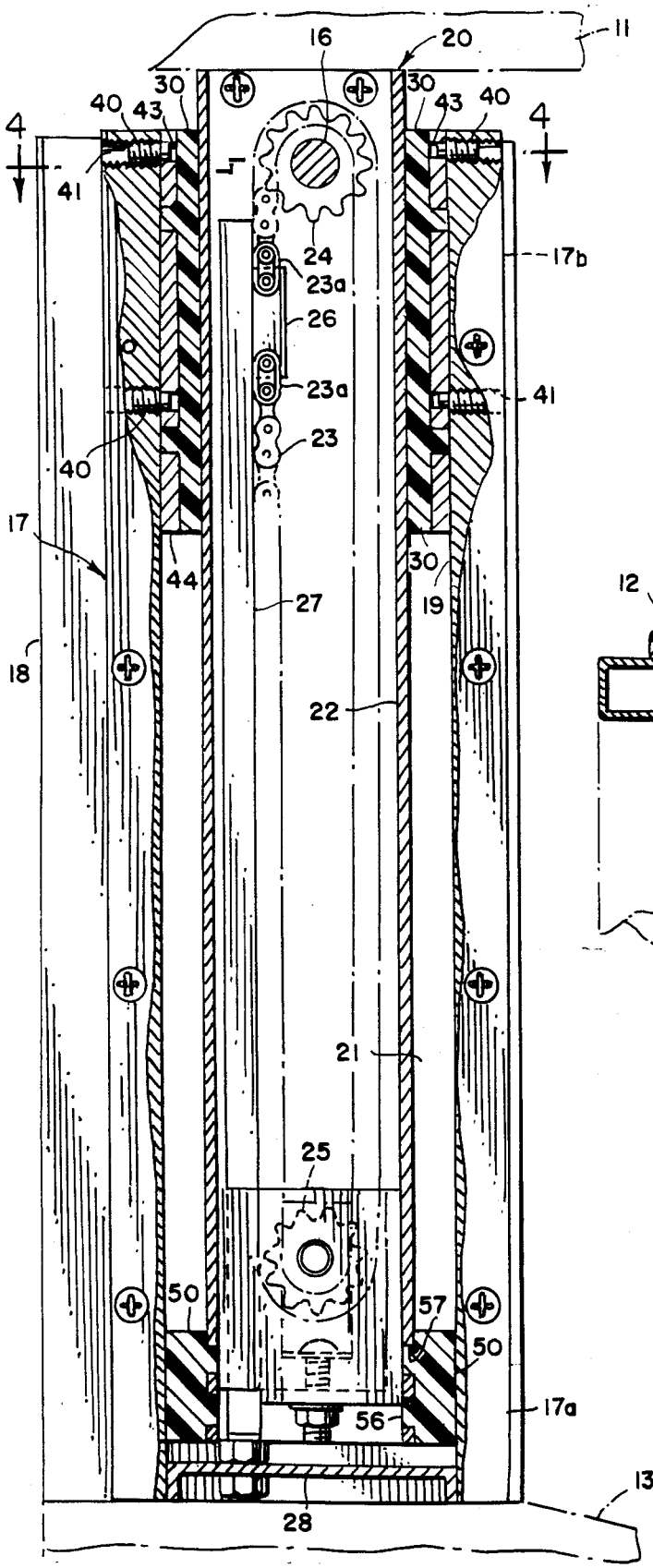
FIG. 3 is an elevational view of a leg assembly, taken partly in section, showing the bearing arrangement therefor.
Figure 4:
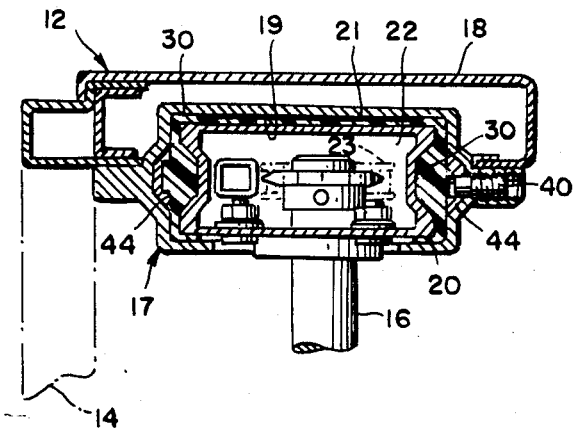
FIG. 4 is a horizontal cross sectional view taken along line 4—4 of FIG. 3.

FIGS. 2–4 illustrate the general relationship between the drive motor 15, drive shaft 16, and the vertically-adjustable leg assemblies 12. Since the two leg assemblies are essentially the same but of reversed orientation (mirror images of each other), the description of one applies to both.

Each leg assembly includes a straight hollow, vertically-elongated tube 17 to which may be attached an outer shell 18 of sheet metal. The shell, shown most clearly in FIG. 4, provides space for wiring and enhances the appearance of the leg assembly. Since the leg assembly would be operative without the shell, emphasis will be directed to the outer tube 17 which functions as a major component of the table support structure.

Outer tube 17 is hollow and of substantially uniform cross section throughout its length, having inner surfaces defining a cavity 19 of generally rectangular cross section. Because of its generally uniform cross section, the outer tube may be advantageously formed by extrusion, although casting or other production procedures might also be used. The lower end **17*a* of the outer tube is secured to base 13 and its upper end 17*b* is open and telescopingly receives inner tube 20. Like the outer tube 17, inner tube 20 is vertically-elongated, hollow, and of substantially uniform cross section throughout its length. Its outside dimensions, when viewed in section, are substantially smaller than the internal cross sectional dimensions of the outer tube 17 so that when the two tubes are telescoped together a perimetric space 21** is defined between the two members (FIGS. 3,4). The inner tube, which may be formed by extrusion, also has a longitudinally-extending cavity which contains part of the mechanism for extending and retracting the inner tube.

More specifically, an endless chain 23, shown largely in phantom in FIG. 3, extends nearly the full length of the cavity of the inner tubular leg member 20. The chain is carried by sprockets 24 and 25, the former being a drive sprocket connected to drive shaft 16 and the latter being an idler sprocket for maintaining the position and tension of the chain. Certain links 23*a* of the chain are connected by mounting bracket 26 to the upper end of a standard 27 extending upwardly into cavity 22 of the inner tube 20. The lower end of the standard is securely connected by plate 28, or by any other suitable means, to the lower end of the outer tube 17. As shown in FIG. 3, the standard or vertical beam 27 extends nearly the full length of the cavity 22 of the inner tube.

If the drive shaft 16 is rotated in a counterclockwise direction (as viewed in FIG. 3), the inner tubular member will be extended, traveling upwardly from the outer member 17 and carrying with it the chain and sprockets of the drive mechanism, the motor 15 housed in panel 14, and the tabletop 11. Reverse (clockwise) rotation of the shaft causes the inner tube 20 to telescope downwardly into the outer tube 17 into the fully-retracted position depicted in FIG. 3.

Figure 5:
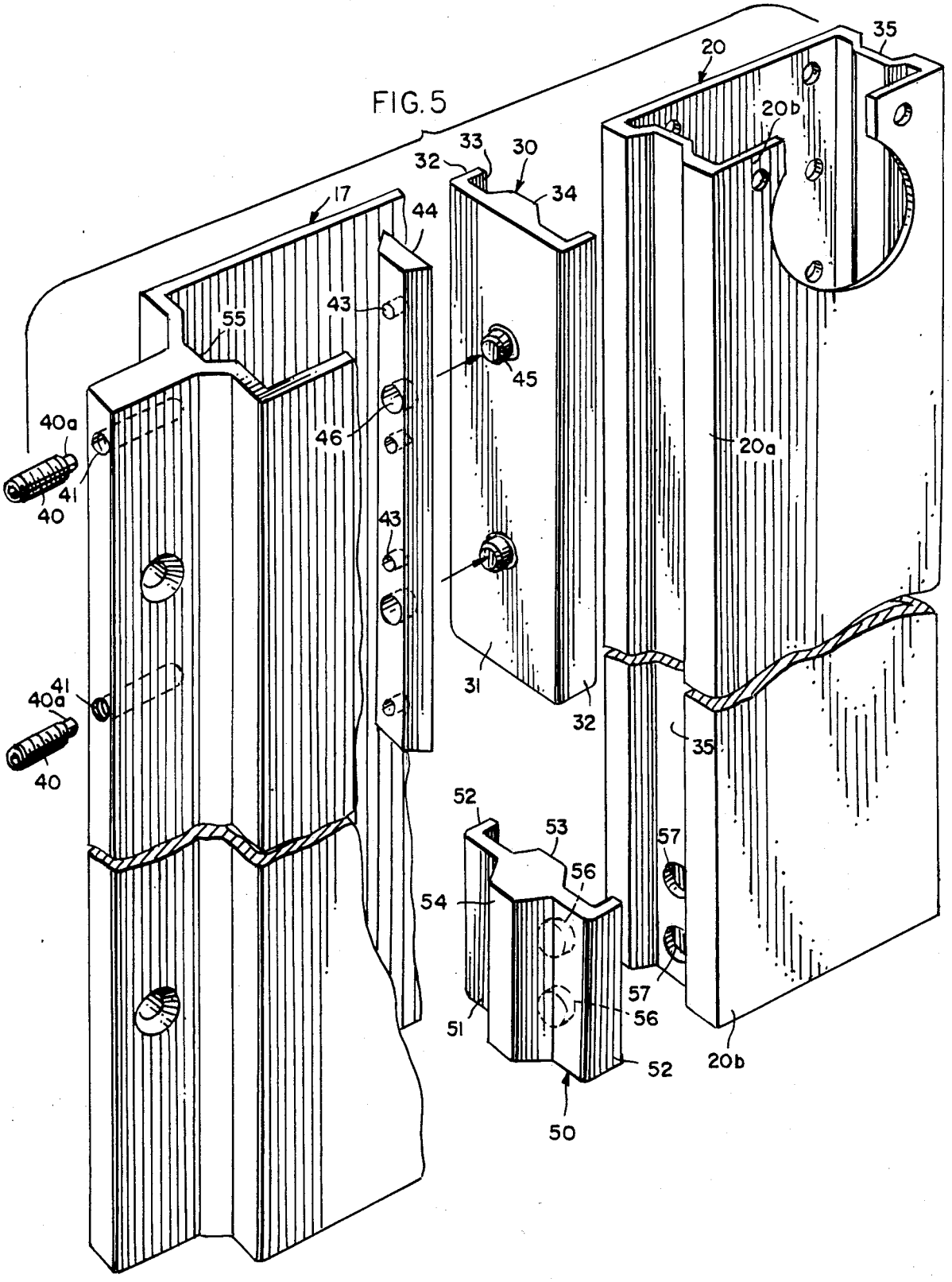
FIG. 5 is an enlarged fragmentary exploded perspective view showing the relationship between the inner and outer tubes and upper and lower bearing elements of the vertically-adjustable leg assembly.

Interposed between the two tubes, and located at the upper end 17*b* of the outer tube 17, are a pair of bearing blocks 30. As shown in FIGS. 3 and 5, each block is vertically elongated and is channel-shaped in section (see also FIG. 4), having a back portion 31 and a pair of side flange portions 32 together defining a channel 33. An integral rib 34 protrudes into the channel from the back portion 31 of the bearing block and is slidably received in a longitudinal recess 35 formed in each of two opposite walls of the inner tube 20 (FIG. 5). The vertical length of each bearing block is particularly significant because, among other things, adjustment to eliminate play is achieved solely by shifting one or both of these blocks. In general, the length of each block should fall within the range of about 20 to 40% of the length of the outer tube 17. With shorter lengths, effectiveness of adjustment would be significantly reduced, and with greater lengths the range of vertical movement (for any given length of outer tube 17) would be severely restricted.

Each bearing block 30 is formed of nylon or other suitable polymeric material having good sliding properties in contact with the metal (preferably aluminum) of inner tube 20. The two blocks 30 are arranged with their channels in facing relation and with the inner surfaces of their back portions 31, and their vertical ribs 34, engaging opposite surfaces 20*a* of inner tube 20. Also, the side flanges 32 wrap about the corners of the inner tube, engaging adjacent faces or surfaces 20*b* of that tube.

The bearing blocks 30 are adjustable in their positions by means of adjustment screws 40 which extend through horizontal threaded openings 41 in outer tube 17. In the construction illustrated, the reduced unthreaded inner end 40*a* of each screw is received in a locating hole formed in a rigid load-distribution bar 44 that is vertically elongated and functions as a stiffening or reinforcing part of the bearing block 30. As shown in FIGS. 3 and 5, each load distribution bar 44 extends the full length of bearing block 30 and is connected to that block by lugs 45 which are formed integrally with the block and project outwardly from its back portion 31 into openings 46 formed in the load distribution bar. The two parts (the load equalization bar and the bearing block) are therefore coupled together and function as a unit in distributing the forces exerted by the verticallyspaced horizontal adjustment screws 40. While bearing block 30 is depicted in the drawings as being provided with a separate load-equalization bar connected to it, the two parts may be permanently joined together or may be integrally formed. It has been found that an integrated bar, formed as an integral outwardly-projecting rib of the bearing block (and therefore of the same polymeric material), and occupying the same space as the separate bar shown in the drawings, will also function effectively in distributing the forces exerted by screws 40.

It is believed apparent that adjustment of the bearing blocks 34 is achieved by tightening (or loosening) the upper and lower adjustment screws until each block contacts the inner tube 20 with uniform force—that is—with force distributed substantially uniformly along the full length of each block and with sufficient force to eliminate play without objectionably restraining sliding movement of the inner tube as it moves between raised and lowered positions. It is to be noted, however, that one of the bearing blocks may be preset in its position so that full adjustment is achieved when the parts are assembled only by rotating the adjustment screws of the other block. This is important where, for example, access to one set of screws becomes difficult or impossible when the parts are fully assembled. If, for example, a front panel 14 should bridge the leg assemblies in the position indicated in phantom in FIG. 4, access to the adjustment screws on that side of each leg assembly would be blocked, at least until the panel were removed. However, even though only one set of screws is essential for adjusting both bearing blocks, it is still important to provide two sets of screws, as shown in FIG. 3, because such an arrangement permits two outer tubes 17 of identical configuration to be used in optically reversed positions while still providing adjustment screws accessible from the same side of the table.

A pair of terminal bearing shoes 50, formed of a polymeric material similar to that of bearing blocks 30, are carried by inner tube 20 at its lower end. Each bearing shoe 50 has a vertical dimension substantially less than the bearing block spaced directly above it but, as indicated most clearly in FIG. 5, has a cross sectional configuration substantially the same as the cross sectional configurations of bearing block 30 and load distributor bar 44 when those parts are connected together. Thus, each bearing shoe 50 is channel shaped with a back portion 51, flange portions 52, and longitudinal rib 53. A second longitudinal rib 54 faces outwardly and occupies the same cross sectional area as load distribution bar 44. However, rib 54 is formed integrally with the bearing shoe 50 and, unlike the load distribution bar 44, is slidably received in the longitudinal recess 55 formed in each of a pair of opposing inner surfaces of the outer tube 17.

The bearing shoes 50 are immobilized with respect to inner tube 20 by means of attachment lugs 56 that project inwardly from inner rib 53 and are received in apertures 57 formed in opposite walls of inner tube 20 (FIG. 5). Therefore, in operation of the leg assembly, as the inner tubular member 20 is raised or lowered, each bearing shoe 50 rides along a pair of opposing inner surfaces of outer tube 17, whereas the upper bearing blocks 30 remain in fixed position with respect to the outer tube 17. When the leg assembly is fully extended, the terminal bearing shoes 50 may engage the lower ends of bearing blocks 30 with such engagement serving to limit the extent of upward movement of the tabletop. Alternatively, the extent of upward movement may be controlled by suitable limit switches (not shown) with engagement between the bearing blocks and the terminal bearing shoes being relied upon only in the event of switch malfunction.

In the illustration given, the tubular member of larger cross section (member 17) is connected to base 13 and the member of smaller section (member 20) is connected to top 11. It is to be understood that the arrangement may be reversed, with the tubular member of smaller cross section (member 20) serving as the lower stationary member connected to base 13 and the larger tubular member 17 constituting the movable upper member connected to top 11. In both cases, the relationship of parts, with particular reference to the bearing assemblies, is basically the same.

While in the foregoing, I have disclosed an embodiment of the invention in considerable detail for purposes of illustration, it will be understood by those skilled in the art that many of these details may be varied without departing from the spirit and scope of the invention.

I claim:

1. An adjustable table leg assembly, comprising an elongated hollow outer tube of substantially uniform cross section throughout its length having inner surfaces defining a cavity of generally rectangular cross section and having an open end; a vertically elongated hollow inner tube telescopingly received in said cavity through said open end of said outer tube and having outer surfaces of generally rectangular outline when said inner tube is viewed in cross section; one of said tubes being adapted for connection at its upper end to a tabletop and the other of said tubes being adapted for connection at its lower end to a floor-engaging base; the external cross sectional dimensions of said inner tube being sufficiently smaller than the internal cross sectional dimensions of said outer tube to define a perimetric space therebetween; first bearing means disposed in said space and connected to inner surfaces of said outer tube adjacent the open end thereof; said means comprising a pair of vertically-elongated bearing blocks of rigid polymeric material and of channel-shaped cross section each having a back portion and a pair of integral flange portions; said bearing blocks being arranged with their channels in facing relation, with their respective back portions slidably engaging opposite outer surfaces of said inner tube and with their flange portions slidably engaging a pair of outer surfaces of said inner tube adjacent to said opposite outer surfaces; and bearing adjustment means mounted upon said outer tube for shifting at least one of said bearing blocks inwardly within said space to position said inner tube in close sliding engagement with both of said blocks along substantially the full vertical extent thereof.

2. The assembly of claim 1 in which said bearing blocks each have a vertical length within the range of about 20 to 40% of the length of said outer tube.

3. The assembly of claims 1 or 2 wherein said assembly includes a second bearing means disposed within said space and secured to the end of said inner tube received in said cavity; said second bearing means being slidably engagable with the inner surfaces of said outer tube.

4. The assembly of claim 3 in which said second bearing means is engagable with said first bearing means to limit the extension of said inner and outer telescoping tubes.

5. The assembly of claim 3 in which said second bearing means comprises a pair of terminal bearing shoes of polymeric material and of channel-shaped horizontal section, each having a back portion and a pair of integral flange portions; said bearing shoes being arranged with their channels in facing relation, with their respective back portions slidably engagable with opposing inner surfaces of said outer tube, and with their flange portions slidably engagable with inner surfaces of said outer tube adjacent to said opposing inner surfaces.

6. The assembly of claim 5 in which each of said shoes includes at least one attachment lug projecting inwardly from said back portion into the channel thereof; and an aperture provided by said inner tube for receiving said lug and securing said shoe and inner tube together.

7. The assembly of claim 5 in which the back portion of each of said bearing shoes includes an integral longitudinal rib extending into the channel thereof; said inner tube having longitudinal recesses along the full length of said opposite outer surfaces thereof for receiving said ribs.

8. The assembly of claim 5 in which the back portion of each of said bearing shoes includes an integral longitudinal rib extending outwardly therefrom; said outer tube having longitudinal recesses along the full length of said opposing inner surfaces for slidably receiving said ribs.

9. The assembly of claims 1 or 2 in which said bearing adjustment means comprises a pair of vertically-spaced threaded openings extending horizontally through the wall of said outer tube; and a pair of adjustment screws threadedly received in said openings for urging said bearing block into close sliding engagement with said inner tube.

10. The assembly of claim 9 in which a rigid load distribution bar is connected to the outer back portion of at least one of said blocks; said adjustment screws being directly engagable with said load distribution bar for urging said block into close sliding engagement with said inner tube.

11. The assembly of claim 10 in which said load distribution bar is provided with at least one opening therein; and a lug received in said opening and provided by the block engaging said bar for securing said bar and block against relative longitudinal movement.

12. The assembly of claim 1 in which power drive means for extending and retracting said leg assembly extends into the interior of said hollow inner tube.

13. A pedestal table having a base, a tabletop, and an adjustable leg assembly extending therebetween; said leg assembly comprising an elongated hollow outer tube of substantially uniform cross section throughout its length having inner surfaces defining a cavity of generally rectangular cross section and having an open end; a vertically-elongated hollow inner tube telescopingly received in said cavity through said open end of said outer tube and having outer surfaces of generally rectangular outline when said inner tube is viewed in cross section; one of said tubes being connected at its upper end to said tabletop and the other of said tubes being connected at its lower end to said base; the external cross sectional dimensions of said inner tube being sufficiently smaller than the internal cross sectional dimensions of said outer tube to define a perimetric space therebetween; first bearing means disposed in said space and connected to inner surfaces of said outer tube adjacent the open end thereof; said means comprising a pair of vertically-elongated bearing blocks of rigid polymeric material and of channel-shaped cross section each having a back portion and a pair of integral flange portions; said bearing blocks being arranged with their channels in facing relation, with their respective back portions slidably engaging opposite outer surfaces of said inner tube and with their flange portions slidably engaging a pair of outer surfaces of said inner tube adjacent to said opposite outer surfaces; and bearing adjustment means mounted upon said outer tube for shifting at least one of said bearing blocks inwardly within said space to position said inner tube in close sliding engagement with both of said blocks along substantially the full vertical extent thereof.

14. The table of claim 13 in which said bearing blocks each have a vertical length within the range of about 20 to 40% of the length of said outer tube.

15. The table of claim 13 in which said assembly includes a second bearing means disposed within said space and secured to the end of said inner tube received in said cavity; said second bearing means being slidably engagable with the inner surfaces of said outer tube.

16. The table of claim 15 in which said second bearing means is engagable with said first bearing means to limit the extension of said inner and outer telescoping tubes.

17. The table of claim 15 in which said second bearing means comprises a pair of terminal bearing shoes of polymeric material and of channel-shaped horizontal section, each having a back portion and a pair of integral flange portions; said bearing shoes being arranged with their channels in facing relation, with their respective back portions slidably engagable with opposing inner surfaces of said outer tube, and with their flange portions slidably engagable with inner surfaces of said outer tube adjacent to said opposing inner surfaces.

18. The table of claim 17 in which each of said shoes includes at least one attachment lug projecting inwardly from said back portion into the channel thereof; and an aperture provided by said inner tube for receiving said lug and securing said shoe and inner tube together.

19. The table of claim 13 in which said bearing adjustment means comprises a pair of vertically-spaced threaded openings extending horizontally through the wall of said outer tube; and a pair of adjustment screws threadedly received in said openings for urging said bearing block into close sliding engagement with said inner tube.

20. The table of claim 19 in which a rigid load distribution bar is connected to the outer back portion of at least one of said blocks; said adjustment screws being directly engagable with said load distribution bar for urging said block into close sliding engagement with said inner tube.

* * * * *